United States Patent [19]

Gephardt

[11] 4,310,994

[45] Jan. 19, 1982

[54] COMPLEMENTARY GEOMETRIC MODULES

[75] Inventor: Roland Gephardt, New York, N.Y.

[73] Assignee: Autonomics, Inc., New York, N.Y.

[21] Appl. No.: 85,266

[22] Filed: Oct. 16, 1979

[51] Int. Cl.[3] ..... E04C 2/04

[52] U.S. Cl. ..... 52/608; 52/DIG. 10

[58] Field of Search ..... 52/81, 82, 79.4, 236.1, 52/DIG. 10, 608, 609; 46/25, 26

[56] References Cited

U.S. PATENT DOCUMENTS

| | | | |
|---|---|---|---|
| 2,493,435 | 1/1950 | Archambault | 46/26 |
| 3,303,604 | 2/1967 | Mote | 46/25 |
| 3,508,367 | 4/1970 | Niebylski | 52/608 |
| 3,568,381 | 3/1971 | Hale | 52/81 |
| 3,645,059 | 2/1972 | Grimm | 52/609 |
| 3,645,535 | 2/1972 | Randolph | 52/DIG. 10 |
| 3,672,110 | 6/1972 | Nordstrom | 52/608 |
| 3,775,919 | 12/1973 | Fulton | 52/79.4 |

FOREIGN PATENT DOCUMENTS

| | | | |
|---|---|---|---|
| 1226372 | 7/1960 | France | 52/79.4 |
| 403228 | 12/1933 | United Kingdom | 46/25 |

OTHER PUBLICATIONS

Order in Space by Critchlow ©1969, Keith Critchlow, pp. 46–49, 53, 57 and Appendix 2.

*Primary Examiner*—Price C. Faw, Jr.
*Assistant Examiner*—Henry E. Raduazo
*Attorney, Agent, or Firm*—Harry Ernest Rubens

[57] ABSTRACT

Complementary geometric construction modules, each derived from a rectangular prism, with end faces formed obliquely to each other and to the longitudinal axis of the prism, with the two oblique faces touching each other at a point on the longitudinal edge of the prism, each module forming a hexahedron, each being the reverse or mirror-shape of the other, and providing bilateral symmetry when the two corresponding faces on the modules, are in full contact with each other; the modules in multiple sets adapted to be formed into a wide variety of sculptured architectural shapes, unique in appearance.

7 Claims, 5 Drawing Figures

COMPLEMENTARY GEOMETRIC MODULES

My invention relates to dual geometric modules for assembly into multipurpose forms.

Hitherto such modular construction has been limited to rectangular prism shapes, or semi-spherical forms known as geodesic domes.

I have discovered a specifically shaped hexahedron, that lends itself, as a building module into unusual geometric structures that are of architectural and artistic sculptured works of art.

Accordingly it is an object of my invention to determine the most desireable arrangement of the hexahedron faces, each of which can be matched to the corresponding face of another similarly shaped face of a complementary hexahedron, to permit combination and recombination into a variety of architectural forms.

Another object is to reproduce the specifically shaped hexahedron into sets of two modules, each of which is the reverse or mirror-shaped image of the other.

Still another object is to form the specially shaped hexahedron, which is derived from a rectangular prism, and therefore easier to package, assemble, and construct.

A further object is to provide the hexahedron shaped module which posseses vertical stability, no matter on which face the module is resting.

These and other objects of the invention are obtained and new results achieved as will be apparent from the geometricforms described in the specification and the claims appended thereto, and illustrated in the accompanying drawing in which:

The dual modules forming the invention may be generated from a rectangular prism with the end faces obliquely shaped with respect to each other and to the longitudinal axis of the prism forming a novel hexahedron with each module the reverse or mirror-shape of the other.

Figure 1:
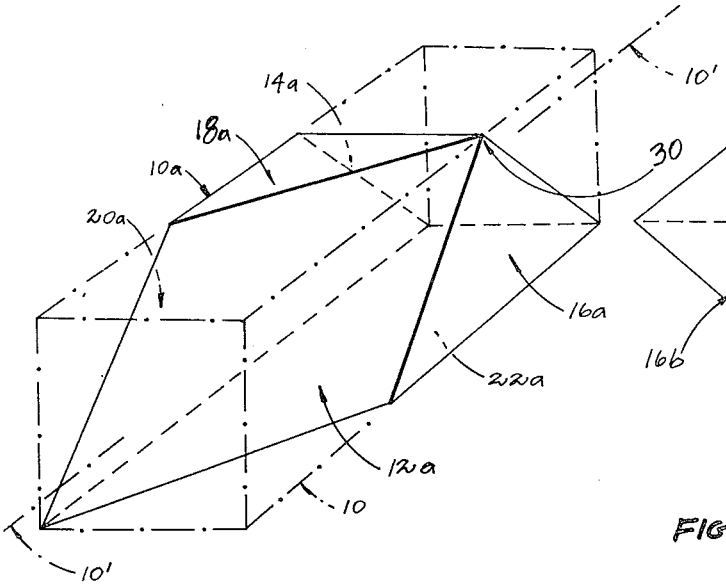
FIG. 1 is a perspective view of one of the dual modules generated from a rectangular prism, shown in dot-dash lines.

More specifically, in FIG. 1 of the drawing, the module 10*a* is shown, generated from the rectangular prism 10, shown in dot-dash lines.

The front and rear end faces, 12*a* and 14*a* respectively, are obliquely formed with respect to the longitudinal axis 10' of the prism, also shown in dot-dash lines, while lateral faces 16*a*, 18*a*, 20*a* and 22*a* remain of the original lateral faces of the prism 10.

The uniqueness of each module is determined by the oblique character of the front and rear end faces. The plane of the rear face may be formed by shaping the face at an angle of 45 degrees to the bottom face 22*a* of the module 10*a*.

Figure 3:
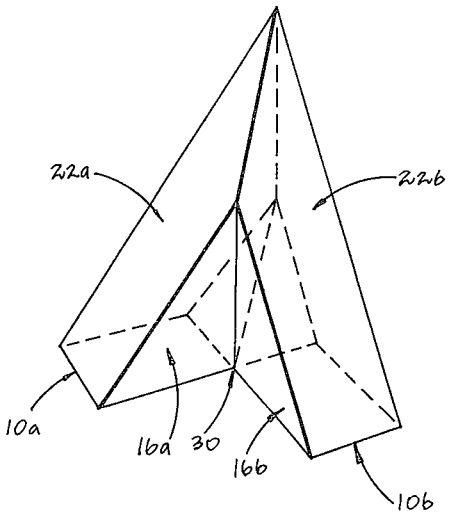
FIG. 3 is a perspective view of the dual modules in pyramidal form.

The plane of the oblique face 12*a* is determined as follows:

(1) The module is placed upon its obligue rear face 14*a*, as is shown in FIG. 3.

Figure 4:
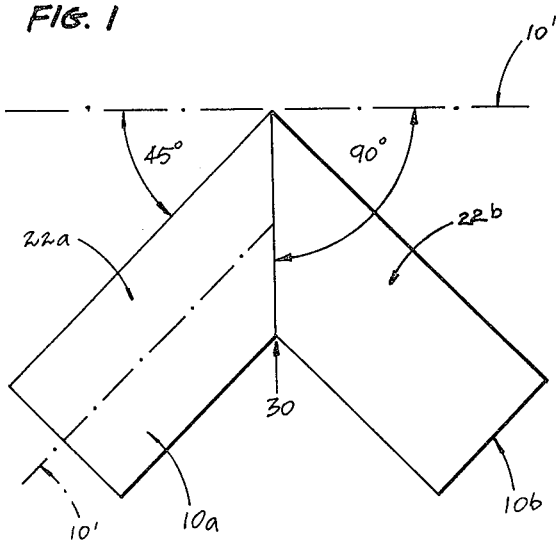
FIG. 4 is a top plan view of the dual modules shown in FIG. 3.

(2) Using reference line 10'', shown in FIG. 4, as a frame of reference, the module is placed on the reference line so that its longitudinal axis coincides therewith.

3. The module is then rotated 45 degrees with respect to the reference line, and the plane forming face 12*a* is formed at right angles to the reference line. This makes faces 12*a* and 14*a*, 45 degrees to the axis.

4. The plane of face 12*a*, should pass through the point 30*a* on the module, where faces 14*a*, 16*a*, and 18*a* intersect. This is precisely shown in FIG. 1. Point 30*a* thus becomes the only point on the hexahedron where four faces engage each other.

Figure 2:
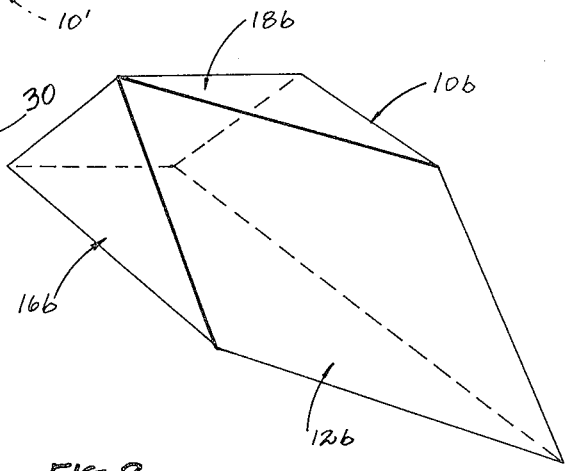
FIG. 2 is a similar view of the other of the dual modules, a reverse or mirror-shaped image of the module in FIG. 1.

In FIG. 2 there is illustrated a complementary module 10*b*, which is the reverse or mirror-image of module 10*a*, the corresponding faces being distinguished therefrom by the corresponding reference numeral followed by the postscript "b".

In the preferred forms shown, the approximate relative proportions of the various face dimensions to each other, and to the basic prism form are as follows:

prism, where "S" is a constant, the proportions are, 1.00S×1.00S×3.50S face 12*a* (parallelogram) the proportions are 1.17S×1.67S face 14*a* (rectangle) the dimensions are 1.00S×1.46S face 16*a* (triangle) the dimensions are 2.08S×1.46S×1.46S face 18*a* (triangle) the dimensions are 1.00S×1.46S×1.67S face 20*a* (trapezoid) the dimensions are 3.50S×1.17S×1.46S×1.46S face 22*a* (trapezoid) the dimensions are 3.50S×1.00S×2.08S×1.67S The figures are substantially correct.

The dual modules when assembled in pairs, with corresponding faces engageing each other, provide a large variety of unique structural shapes to be formed, having unusual visual interest. Together the two complementary modules provide bilateral symmetry which gives visual balance to the modules, not present in each of the modules when alone.

The pyramidal construction of FIG. 3 forms a right angle corner structure where required, as is seen in the top view of the construction in FIG. 4.

Figure 5:
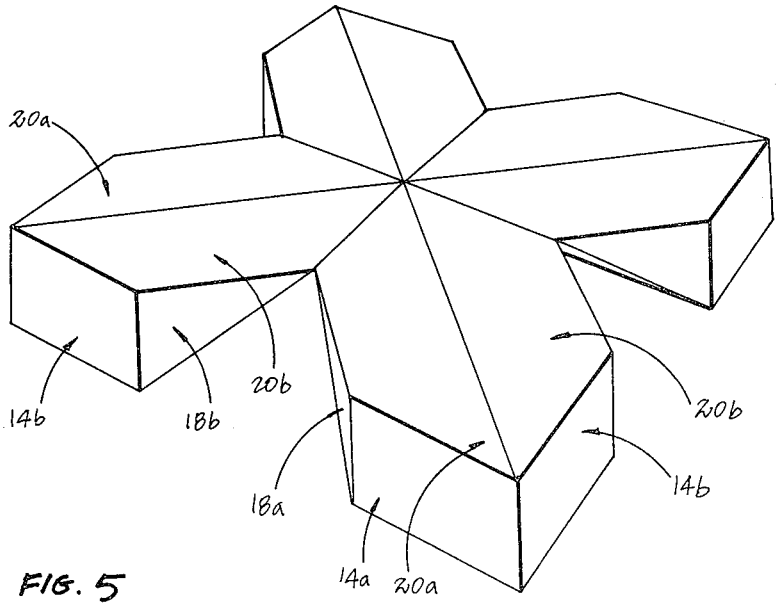
FIG. 5 is a perspective view of one arrangement of a plurality of sets of dual modules assembled into a unitary structure.

In FIG. 5, the cruciform structure is established by four sets of complementary modules. Eight of such modules can produce thousands of structural shapes that can be defined as sculptured architecture. Dimensioned in inches, the modules are useful as models for experimentally evolving new interesting forms that can be visually inspected prior to large scale production.

The structures formed have exceptional stability derived from the the character of each irregularly shaped hexahedron which can be placed on any of its six faces and be vertically stabile with respect thereto, without lateral support.

With the two obliquely formed corresponding faces in contact with each other, the modules may be erected into a solid wall having a thickness of 1.00S, as indicated before in the study of comparative dimensions. The modules may also be made hollow to permit the installation of wires and pipes therethrough or for insulating materials. The modules may be formed of pipes as is done with the geodesic dome, or wooden or metal beams as is conventionally done with a truss structure employing the usual joint connectors.

To permit greater structural strength, the non-triangular faces may reinforced by cross-struts, to provide a statically determinate structure.

I have thus described my invention but it should be understood that it is not confined to the particular form or use shown and described, the same being merely illustrative, and that the invention may be carried out in other ways without departing from the spirit of my invention, since the particular embodiment herein shown and described is only one of the many that can be employed to obtain the objects of the invention and accomplish the new results.

I claim:

1. Complementary pairs of geometric modules for forming structural shapes, each generated from a rectangular prism, with two opposite end faces, one of the end faces forming a right angled quadrangle, and the other end forming a obligue angled quadrangle, both end faces obliquely formed with respect to the longitudinal axis of the prism, each of said modules being the reverse or mirror shape of its complementary module, said module and its complement being non-identical modules.

2. The modules of claim 1, wherein the plane of each end face is formed at a 45 degree angle to the longitudinal axis of the module.

3. The modules of claim 1, wherein the plane of each end face intersects the plane of the other end face at a corner of the module.

4. The modules of claim 1, wherein the other end face of each module is formed at a 45 degree angle to the longitudinal axis of each module.

5. The modules of claim 1, wherein the largest cross-section of each module with respect to its longitudinal axis is a square.

6. The modules of claim 1, wherein the plane of each end face is formed at a 45 degree angle to the longitudinal axis of the module, and 90 degrees to the plane of the other end face.

7. The modules of claim 1, wherein the plane of each end face intersects two side faces and the other end face at a point.

* * * * *